US006233795B1

(12) United States Patent
Dischler

(10) Patent No.: US 6,233,795 B1
(45) Date of Patent: May 22, 2001

(54) FACE FINISHING OF COTTON-CONTAINING FABRICS CONTAINING IMMOBILIZED FIBERS

(75) Inventor: Louis Dischler, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/570,253

(22) Filed: May 12, 2000

Related U.S. Application Data

(63) Continuation-in-part of application No. 09/252,513, filed on Feb. 18, 1999, now Pat. No. 6,112,381.

(51) Int. Cl.[7] ..... D06C 11/00

(52) U.S. Cl. ..... 26/28; 26/29 R; 28/166; 28/167; 28/169; 28/151

(58) Field of Search ..... 26/28, 29 R, 27, 26/30, 37, 69 C, 2 R; 28/169, 162, 163, 151, 152, 166, 167, 165; 427/277, 271, 278, 226, 289, 356, 359, 368; 139/1 R, 307, 391, 383 R; 8/116.1, 478, 537, 918, 115.6, 115, 151, 152; 156/154, 281; 451/29, 54

(56) References Cited

U.S. PATENT DOCUMENTS

| | | | | |
|---|---|---|---|---|
| 2,107,528 | | 2/1938 | Feinberg | 26/28 |
| 2,896,304 | | 7/1959 | Peroni | 28/319 |
| 2,926,414 | | 3/1960 | Weiss et al. | 26/69 |
| 3,549,398 | | 12/1970 | Watson | 117/8 |
| 3,650,800 | | 3/1972 | Reiner | 117/37 |
| 3,894,318 | | 7/1975 | Ito et al. | 26/28 |
| 3,973,359 | | 8/1976 | Spencer et al. | 51/75 |
| 3,980,549 | | 9/1976 | Grutza | 204/16 |
| 4,051,699 | * | 10/1977 | Carpenter, Jr. | 26/27 |
| 4,463,483 | | 8/1984 | Holm | 26/29 P |
| 4,468,844 | | 9/1984 | Otto | 26/28 |
| 4,512,065 | | 4/1985 | Otto | 26/28 |
| 4,607,409 | * | 8/1986 | Hishimuma et al. | 8/152 |
| 4,608,128 | | 8/1986 | Farmer et al. | 204/16 |
| 5,199,957 | * | 4/1993 | Pascoe | 8/478 |
| 5,407,447 | * | 4/1995 | Teague et al. | 8/483 |
| 5,473,801 | | 12/1995 | Straube et al. | 26/33 |
| 5,505,739 | | 4/1996 | Montesano | 8/102 |
| 5,752,300 | | 5/1998 | Dischler | 26/28 |
| 5,815,896 | | 10/1998 | Dischler | 26/28 |
| 5,958,083 | * | 9/1999 | Onishi et al. | 8/802 |
| 6,015,707 | * | 1/2000 | Emalfarb et al. | 8/401 |

* cited by examiner

*Primary Examiner*—Amy B. Vanatta
(74) *Attorney, Agent, or Firm*—Terry T. Moyer; William S. Parks

(57) ABSTRACT

A process for abrading fabrics to produce a sueded hand is provided. In particular, the process is directed to the sueding of cotton containing fabrics both before and after mercerization, to produce a unique combination of hand and retained fabric strength. Fabrics treated by this process are also contemplated within the scope of this invention.

20 Claims, 1 Drawing Sheet

FACE FINISHING OF COTTON-CONTAINING FABRICS CONTAINING IMMOBILIZED FIBERS

CROSS REFERENCE TO RELATED APPLICATIONS

This application is a continuation-in-part of application 09/252,513, filed on Feb. 18, 1999, now U.S. Pat. No. 6,112,381. This parent application is herein entirely incorporated by reference.

FIELD OF THE INVENTION

The inventive method is directed to a process for abrading fabrics to produce a sueded hand. In particular, the process is directed to the sueding of cotton containing fabrics both before and after mercerization, to produce a unique combination of hand and retained fabric strength. Fabrics treated by this process are also contemplated within the scope of this invention.

BACKGROUND OF THE PRIOR ART

Materials such as fabrics are characterized by a wide variety of functional and aesthetic characteristics. Of those characteristics, a particularly important feature is fabric surface feel or "hand." The significance of a favorable hand in a fabric is described and explained in U.S. Pat. Nos. 4,918,795 and 4,837,902, both to Dischler, the teachings of which are both entirely incorporated herein by reference.

Favorable hand characteristics of a fabric are usually obtained upon conditioning of prepared textiles (i.e., fabrics which have been de-sized, bleached, mercerized, and dried). Prior methods of prepared-fabric conditioning have included roughening of the finished product with textured rolls or pads. It has now been discovered, surprisingly, that such conditioning would favorably be preformed while the target fabric is in its greige state or is unprepared. The conditioning of such fabrics provides heretofore unknown benefits in improvements in overall fabric strength, and the like (as discussed in greater detail below). Of great importance and necessity then within the textile treatment industry is a procedure through which greige or unfinished fabrics can be treated and subsequently finished which provides desirable hand to the target textile and does not adversely impact the ability for dyeing, decorating, and the like, the textile at a future point in time. Such processes have not been taught nor fairly suggested within the pertinent art. Thus, there is no prior teaching nor fair suggestion within the pertinent art which has accorded highly effective and easily duplicated textile hand improvements to greige goods and unfinished textiles.

In the textile industry, it is known to finish woven fabrics by abrading one or both surfaces of the fabric using sandpaper or a similarly abrasive material to cut and raise the fibers of the constituent yarns in the fabric. Through such a treatment, a resultant fabric is obtained generally exhibiting a closely raised nap producing a soft, smooth surface texture resembling suede leather. This operation, commonly referred to as sueding or sanding, is conventionally performed by a specialized fabric sueding machine wherein the fabric is passed under tension over one or more finishing rolls, covered with sandpaper or a similarly abrasive material, which are rotated at a differential speed relative to the moving fabric web. Such machines are described in U.S. Pat. Nos. 5,752,300 and 5,943,745, both to Dischler, and 3,973,359 to Spencer, all hereby entirely incorporated by reference.

Another well known technique for enhancing aesthetic and performance characteristics of a fabric through the same type of surface-raising treatment is napping. Such a treatment provides a fabric exhibiting a softer hand, improved drapeability, greater fabric thickness, and better overall durability. Napping machinery generally utilizes rotatably driven cylinders including peripheral wire teeth, such as, normally, card clothing, over which the fabric travels under a certain amount of tension.

During a napping treatment the individual fibers are ideally pulled from the fabric body in contrast to sueding which ideally cuts the individual fibers. Sueding, however, presents some disadvantages including the fact that a certain amount of napping occurs simultaneously. Grit particles engage the surface fibers of the target fabric and inevitably pull them from the fabric body resulting in a relatively long pile. Such a long pile traps air at the surface of the fabric creating an insulating-type effect which thereby produces a warm feeling against the wearer's skin. Such fabrics commonly contain a proportion of cotton (65% polyester/35% cotton, for merely one example), or contain substantially all cotton fibers.

Methods have been utilized in the past on such cotton-containing prepared fabrics to produce a short pile in order to produce the most desirable hand characteristics. These have included the use of sand paper with very fine grit, brush rolls with grit particles embedded in soft nylon bristles, and even blocks of pumice stone mounted upon oscillating bars. However, the fine grit sandpaper degrades easily and rapidly due to the loss of grit particles and the build-up of debris between the remaining particles. Furthermore, the target fibers arc not cut in this fashion as much as they are generally eroded. Thus, fine grit sandpaper does not provide an effective process of replacing the sueding techniques mentioned above. Soft nylon bristles also appear to merely erode the fibers away than cut and also is highly inefficient because of the light pressure such devices apply to the target fabric. Pumice stone, being very soft, is itself subject to damage in such operations and also facilitates unwanted build-up of fibrous debris within the treatment surface of the stone. Undesirable wet procedures are generally necessary to produce any effective sueding results for pumice stone and fine grit sandpaper treatments.

Another disadvantage of prior napping and/or sueding treatments concerns the situation where fill yarns are exposed on the surface of the target fabric. Being perpendicular to the action of the napping and/or sueding, such treatments tend to act primarily upon these exposed yarns rather than the warp yarns. Weaving economy generally dictates that the target fabric would be more heavily constructed in the warp direction and thus it would be highly advantageous for sueding to act primarily on such warp yarns since those yarns exhibit more strength to relinquish during the abrasion procedure.

The present inventive method thus provides a significant improvement in hand characteristics for fabrics comprising a substantial amount of cotton fibers (i.e., greater than about 25%, preferably greater than about 40%, more preferably greater than about 50%, and most preferably, 100% cotton). Such a specific method produces a short, dense pile with a simultaneous appealing hand benefit, without undue loss in strength to the overall cotton-containing fabric. Such a method and the cotton-containing fabrics made thereby are herertofore unknown to the apparel textile industry.

OBJECTS OF THE INVENTION

The primary object of this invention is therefore to provide improved sueded hand to cotton containing fabrics while also retaining a balanced strength over the entire fabric structure. It is thus an additional advantage of this invention to provide such a method that is highly cost-effective and enhances subsequent fabric processing such as de-sizing, mercerization, dyeing, and the like. Another object of this invention to be provide a method of improving the hand of mercerized fabrics comprising cotton fibers. These and other advantages will be in part apparent and in part pointed out below.

DESCRIPTION OF THE INVENTION

In order to improve the hand of fabrics in a manner which is consistent with warm weather wear, the constituent fibers must be treated in a manner which provides a consistently short pile, so that a stagnant layer of insulating air is not trapped at the fabric surface. It has been found that, by first immobilizing the fibers constituting the fabric with a temporary coating, followed by an abrasive treatment of the fabric surface, and then removal of the temporary coating, a fabric of unique aesthetic and practical characteristics is obtained. Compared to a fabric which has been sanded or napped, a fabric treated by the present inventive method is cooler to the touch, smoother to the hand, and dramatically more resistant to pilling. To understand how these advantageous characteristics are obtained, it is useful to compare the action of card wire on a film of polyester (e.g., Mylar™) to the action of the wire on a polyester fabric. When card wire is dragged across a Mylar™ film under pressure, many small scratches are seen to develop in the surface, due to the combination of high pressure at the wire tip combined with the high hardness of the wire relative to polyester. When the wire is similarly dragged across the polyester fabric, scratches are generally not found since the motion of the fibers relative to each other allows the stresses to be dissipated before abrasive wear occurs. Also, the interaction of wire and fiber typically tensions the fiber and draws it away from the yarn surface. When the fabric subsumes the characteristics of a film, scratching of the fiber surface does then occur, and pulling out of fibers from the yarn is prevented. Thus, the fabric is transformed into film (or composite), abraded, and then transformed back into a fabric. What would be linear scratches on a film appear as nicks of various sizes on the surface fibers, including nicks which entirely cut through some of the fibers. The cut fiber ends will be released during subsequent processing (e.g., de-sizing) to form a pile which is uniformly short. Short fibers resist forming pills because the number of adjacent fibers available for entanglement is limited to those few within reach of each other. "Nicks" on these fibers serve as stress risers, allowing the fiber to break off during the kind of bending that occurs during pill formation. Since only the surface fibers have been so weakened, the bulk of the fabric strength has been retained as compared to chemical treatments, which necessarily weaken the entire fabric structure.

The term "nicking" basically encompasses the creation of cuts at random locations on individual fibers thus providing stress risers on the individual fibers. The immobilization of these fibers thus increases frictional contact between the individual fibers and prevents movement of the fibers during the sanding, abrading, or napping procedure. The abrading, sanding, or napping of non-immobilized fibers which move during treatment can result in the relative motion of the fibers and the pulling out of long fibers as the fibers interact with the abrasive or napping media. Such a process does provide improvements in the hand of such fabrics; however, the filling strength of the fabric may be sacrificed and the ability of the fabric to trap unwanted air (thus producing a "warmer" fabric) is increased. Therefore, the inventive process comprises first immobilizing the surface fibers of a fabric with a temporary coating; second, treating the immobilized surface fibers by abrasion, sanding, or napping in order to cut and "nick" the fibers; and third, removing, in some manner, the temporary coating.

The immobilization step thus comprises encapsulating at least the surface fibers (and possibly some of the internal fibers of the fabric) in a coating matrix which makes the fibers stationary to the point that the individual fibers are resistant to motion due to the space-filling characteristics of the coating matrix within the interstices between the fibers, as well as the adhesion of adjacent fibers by the coating matrix. A typical coating matrix which imparts immobilization on the surface fibers of a target fabric is size (i.e., starch, polyvinyl alcohol, polyacrylic acid, and the like) which can easily be removed through exposure to water or other type of solvent. Usually, size is added to warp yarns prior to weaving. In accordance with this invention, the size already present in the greige goods to be abraded may be employed for the purpose of immobilization; alternatively, additional size may be coated onto the target fabric to provide a sufficient degree of rigidity.

To be effective (i.e., to impart the proper degree of rigidity or immobilization to the target fibers), the coating does not have to fill the entire free space of the yarn; however, a solids coating level of between 5 and 50% by the weight of the fabric has been found to be particularly effective. A coating range of between 10 and 25% of the weight of the fabric is most preferred. In one particularly preferred embodiment, a greige fabric is to be subsequently treated through sanding, abrading, or napping but does not require any further application of size. As long as the size present during the weaving procedure is not removed thereafter, sufficient rigidity will exist for proper immobilization of the target fabric for further treatment by sanding, abrading, or napping within the inventive process. Another preferred method of immobilization through size application is to dissolve the coating agent in water and pad onto the fabric, followed by a drying step; however, this encompasses both sized (greige) and de-sized fabrics.

Another temporary coating available within the inventive immobilization step is ice. In such an instance, 50 to 200% by weight of water is applied to the target fabric that is subsequently exposed to subfreezing temperatures until frozen. The fabric is then abraded while frozen and then dried. One embodiment of this type of immobilization includes padding on at least about 50% owf and at most about 200% owf water and then freezing the water in situ. Such a method may be utilized on greige, prepared, or finished goods and it eliminates the need to add extra amounts of size to an already-woven fabric. This elimination of the need to add and recover size is therefore highly cost-effective. If ice is utilized to immobilize the constituent fibers of the target fabric, napping with metal wires or brushes is the preferable method of treating the target fabric. Wire allows ice, which has melted and refrozen, to break free easily. The resultant ice film could render sanders and/or abraders ineffective since the grit generally utilized in those procedures is very small and would not penetrate through the film to "nick" the individual fibers as is necessary for this inventive process to function properly. The frozen target fabric is preferably maintained at a low temperature (at least from about −10 to about −50° C.), both to insure that the ice has sufficient shear strength for immobilization, and to provide enough heat capacity to absorb the mechanical energy imparted by the abrasion process without melting.

As noted above, the size employed as an aid to weaving may be retained subsequent to weaving, and employed in the present invention to immobilize the target fibers. This is believed to be unique within the textile industry. While such processes as singeing and heat-setting may be applied to greige goods, neither process obtains the advantages from the presence of size on the greige fabric. Otherwise, size is removed from greige goods prior to any further treatment (such as mercerizing, bleaching, dyeing, napping, sanding, and the like).

Mercerization is a required step in this invention in order to provide the beneficial properties available through the utilization of cotton fibers within fabrics. By this process a number of beneficial effects are produced, amongst which are increases in the values of the properties of dyestuff affinity, tensile strength and luster, improved coverage of "dead cotton", and increased dimensional stability to laundering. Mercerization is commonly performed upon textile materials of a cellulosic nature, especially cotton, linen, and blends or mixtures of such with other natural or man-made fibers. To provide full mercerization and the maximum development of the above properties, long established theory and practice has set necessary chemical and process conditions, the process sequence, and apparatus requirements.

Thus, in such a procedure, caustic soda, being relatively inexpensive, capable of regeneration and widely available in various physical forms and concentrations, is utilized as a universally-accepted, and nearly the exclusive swelling agent,. The target fabric is impregnated with a solution of caustic soda of a strength between 45° TW to 60° TW for a period of not less than 45 seconds and at a temperature between 5° to 20° C. The fabric is then washed with hot water and certain tension conditions imposed and maintained upon the fabric during the washing until the fabric contains less than 5% caustic soda. Thereafter, residual caustic soda may be finally removed by further washing and or neutralization without tension control.

Mercerizing of cotton yarn may also be performed, the yarn being either wound in hank form, or in the form of a ribbon or rope of continuous threads.

While fabric and yarn mercerization, have depended upon the impregnation with caustic soda of defined concentrations, specific times and low temperatures, and the imposition and maintenance of tension during the removal of caustic soda by washing, various variations are know, for example, the times and temperatures may be widely varied from room temperature, and pressure above atmospheric may also be used. The concentration of caustic may widely varied depending upon the degree of mercerization desired, and ammonia may also be used, as taught in U.S. Pat. No. 3,980,429 to Lawrence, et al. and hereby incorporated by reference.

Although mercerization is required to provide the ultimately desired luster, etc., properties to the constituent cotton fibers, in actuality the most important step within the inventive method is the immobilization of the surface fibers. Abrading, sueding, sanding, napping, and the like, (or any combinations of these) may be utilized within the inventive process. Thus, abrading through contacting a fabric surface with an abrasive-coated cylindrical drum rotating a speed different from that of the fabric web is one preferred embodiment within this inventive process. Such a method is more fully described in U.S. Pat. Nos. 5,752,300 and 5,815,896, both to Dischler, herein entirely incorporated by reference. Angular sueding, as in U.S. patent application Ser. No. 09/045,094 to Dischler, also herein entirely incorporated by reference, is also an available method. The preferred abrasive is diamond grit embedded in an electroplated metal matrix that preferably comprises nickel or chromium, such as taught within U.S. Pat. No. 4,608,128 to Farmer. Other hard abrasive particles may also be used such as carbides, borides, and nitrides of metals and/or silicon, and hard compounds comprising carbon and nitrogen. Electroless plating methods may also be utilized to embed diamond and other hard abrasive grit particles within a suitable matrix. Preferably, the diamond grit particles are embedded within the plated metal surface of a treatment roll with which the target fabric may be brought into contact so that there is motion of the fabric relative to the grit particles. Since both the diamond facets and the metal matrix are microscopically smooth, build-up of size coating on the abrasive treatment surface is generally easily avoided. However, as noted previously, a more severe problem occurs where ice is utilized as the immobilizing matrix. The pressure of the fabric in contact with the small abrasive grit particles may cause the ice to melt and instantly refreeze onto the abrasive-coated cylinder. Also, since ice is generally weaker than polymeric sizing agents, a greater weight add-on is required to provide sufficient rigidity to the individual fibers. A thicker layer of coating thus results on the surface, and this superficial ice thickness interferes with the contact of the grit particles with the target fibers. As such, the grit particles would not be sufficient to "nick" the surface fibers. In such an instance, a napping procedure is preferred which utilizes wire brushes to condition the fabric surface, as taught in U.S. Pat. No. 4,463,483 to Holm. A cylindrical drum may still be utilized in such a situation with a napping wire wrapped around the drum which is then brought into contact with the target fabric, again a speed different from that of the fabric web. Normally, napping in this manner pulls the surface fibers away from the fabric surface; in the inventive method, the fibers are held in place and the desirable and necessary "nicking" of the individual fibers is thus accomplished. The bending of the wire during contact with the fabric allows ice to continually break free while the length of the wire insures that the ice coating can be penetrated and the "nicking" procedure is, again, accomplished.

Also of particular interest is the fact that sueding of cotton/synthetic fiber blend fabrics in the greige state, prior to mercerization, is now known to produce unexpectedly beneficial effects. Historically, synthetic fibers for use in apparel, including polyester fibers, have generally been supplied to the textile industry with the object of duplicating or improving upon the characteristics of natural fibers. Such synthetic textile filaments were mostly of deniers per filament (dpf) in a range similar to those of the standard natural fibers (i.e., cotton and wool). More recently, however, polyester filaments have been available on a commercial level in a range of dpf similar to natural silk (i.e., of the order of 1 dpf), and even in subdeniers (below 1 dpf). Such fibers and considerably finer and more flexible than typical cotton fibers and thus are potentially preferred in the industry over such natural fibers. It has thus been discovered that fabrics containing cotton blended with such low dpf polyester fibers treated in accordance with this inventive method, then subsequently mercerized, exhibit a sueded surface that is substantially dominated by the synthetic fibers. This effect occurs because the cotton portion of the generated pile tends to kink, bend, and shorten due to the swelling effect of the caustic on the cut cotton fibers. These fibers tend to swell to the greatest possible degree since they are not tensioned. Kinking and bending is further accentuated by the presence of "nicks" on these fibers, resulting in localized swelling where the cuticle of the cotton fiber is breached. The same effect does not occur with the cut polyester or other synthetic fibers that do not swell in the presence of caustic, so that the synthetic fibers ultimately dominate the surface aesthetics. This is advantageous when the target fabric contains synthetic fibers that are more flexible than mercerized cotton fibers, usually in the range of 1.5 dpf or less for polyester fibers. Such a benefit has not been readily available to the industry until now.

Abrasion of greige fabrics is generally less satisfactory for fabrics containing a substantial portion of cotton fibers, and is generally unsatisfactory for fabrics containing substantially all cotton fibers, when such fabrics are subjected to mercerization subsequent to the abrasive step. The NaOH used in mercerization irreversibly swells cotton fibers, and this swelling is greatest in fibers that are not under tension. In particular, the fibers cut by an abrasive treatment are under no tension, and therefore swell and thicken more than fibers within the yarn bundle. With a larger diameter, such fibers are stiffer, degrading the perceived hand. Nicks on the fibers which rupture the outer layers of the spirally wound cellulose fibrils of the cotton fiber result in differential swelling in these partially cut areas. These fibers become severely kinked, and this kinking is believed to further degrade the perceived hand. Finally, the cut ends of the fibers swell more that the fiber itself, producing knobby terminations, and increasing the subjective sensation of coarseness.

A secondary abrasive treatment, subsequent to mercerization, has been found to straighten the fibers comprising the pile, and to substantially fibrillate the fibers, especially the knobby terminations, producing tapered terminations that are perceived as being much softer. The advantages of a uniformly short pile accruing from the initial greige abrasive treatment is maintained, while the presence of the initial pile fibers tends to protect the base fabric from further abrasion, maintaining the strength advantage of greige sueding. The secondary abrasive treatment may be performed on the fabric directly after mercerization, or may be performed later, after dyeing and/or finishing.

The particular types of fabrics which may be subjected to the inventive method are myriad as long as they contain a significant amount of cotton fibers (as noted above, anywhere from 25% to 100% of such fibers is preferred). Any fabric blends may include, without limitation, any synthetic and/or natural fibers, including synthetic fibers selected from the group consisting of polyester, polyamide, polyaramid, rayon, lycra, and blends thereof, and natural fibers are selected from the group consisting of wool, flax, silk, ramie, and any blends thereof. The fabrics may also be constructed as woven, non-woven, and/or knit materials. Preferably, the target fabric comprises synthetic fibers and is woven. More preferably, the fabric comprises woven cotton (and other synthetic) fibers in spun yarns. It has been determined that warp-faced twill fabrics are particularly suited to this inventive process because all of the exposed surface yarns of the woven substrate are sized which thus results in immobilization of all of the desired fibers thereby facilitating surface treatment to provide a balanced fabric strength.

While the description heretofore has been directed to the abrading of cotton rich fabric in the greige (i.e., with at least the warp yarns still coated with size), the process may also be achieved by sueding scoured (de-sized) cotton rich fabric, followed by a mercerization step, and finally a second abrasive step. This produces a soft face-finished product, albeit will a longer pile and a warmer feel as compared to fabrics which have been first greige sueded.

Any standard sueding and sanding (and possibly, though much less desired, napping) machine may be utilized to produce the inventive fabrics. As merely a few examples, potentially and preferably utilized machines include those disclosed within U.S. Pat. Nos. 5,943,745 and 5,815,896, both to Dischler. However, the particularly preferred machine for the production of the finished inventive fabrics comprises at least one treatment tube to which diamond grit has been incorporated within an electroplated nickel matrix. The tube is set to rotate either with or against the direction of the web of fabric to be treated and is configured either substantially perpendicular to or angularly related to said fabric web. The rotation speed of the tube (or even more preferably tubes) is greater than that of the speed of the fabric web. With the fibers of the fabric being immobilized (through the non-removal of size after weaving, for instance), this particular machine thus permits the desired "nicking" of the constituent fibers and the minimal pulling of such fibers from the fabric face. In such a procedure, the resultant pile height is very low, yet the fabric itself exhibits hand characteristics comparable to non-immobilized fiber treatments for similar types of fabrics. It is preferred that the abrasive covered tubes be utilized in counterrotating pairs so that an equal amount of treatment is imparted in each direction on the target fabric surface. Furthermore, when both sides of the target fabric are to be treated, it is preferred that the face be treated first with a subsequent treatment to the back side. This specific sequential treatment best ensures that, if any breakdown of the immobilizing coating matrix (such as, preferably, size) occurs, any cut long hairs present on the back side of the fabric will not thereafter be pulled from the target fabric face. The actual machine is described in greater detail in the drawings discussed below.

DETAILED DESCRIPTION OF THE DRAWINGS

Figure 1:
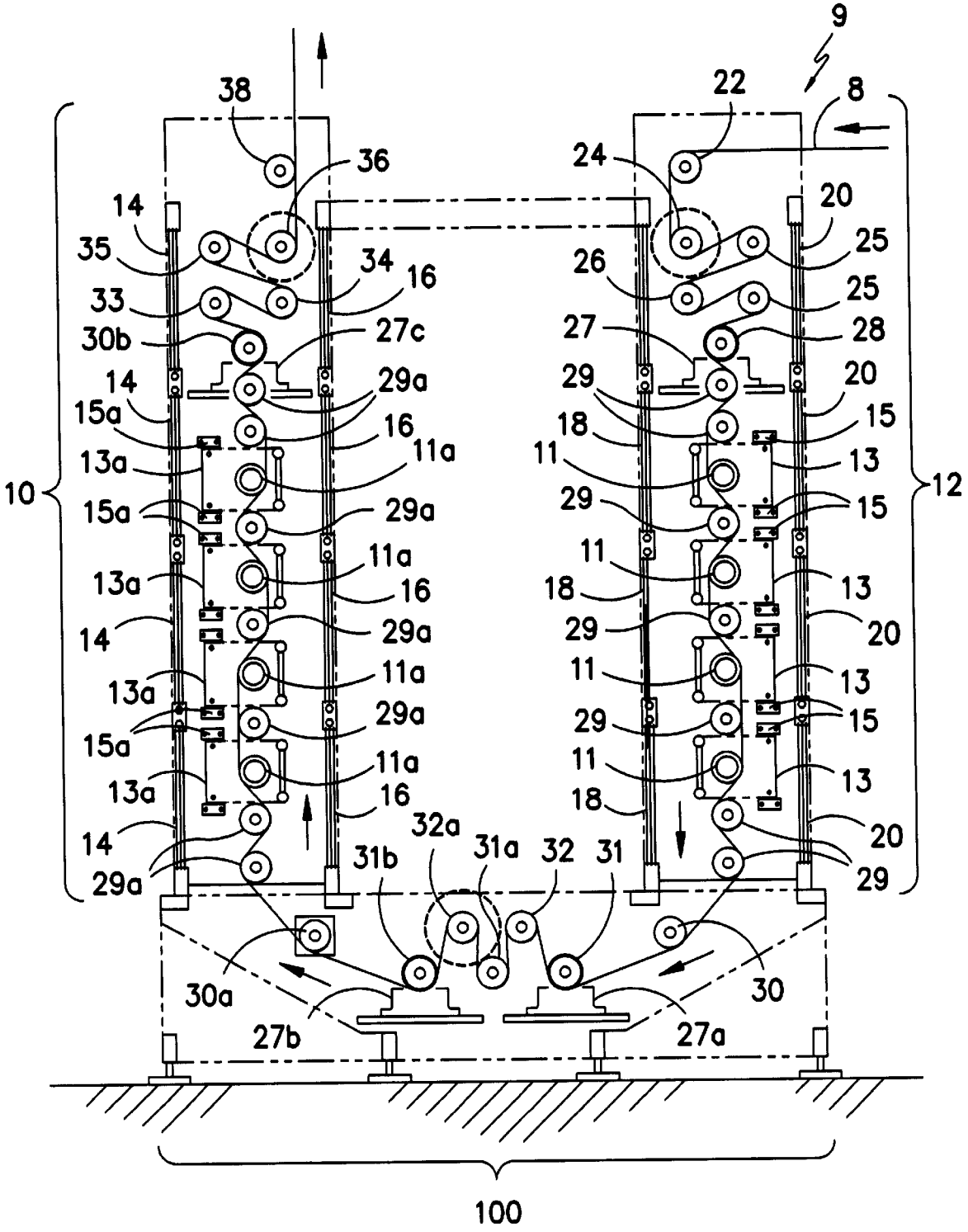
FIG. 1 represents a cross-sectional view of a preferred fabric treatment apparatus.

As depicted in FIG. 1, a web of fabric 8 is moved through an apparatus 9 having two separate treatment chambers 10, 12, and an intermediate chamber 100. After the web 8 enters the first treatment chamber 12, it is directed over idler roll 22 to drive rolls 24, 26, which are geared together in a one-to-one relationship by means of a synchronous belt (not shown). Sufficient wrap on the drive rolls to achieve traction on the web is accomplished by directing the web over idler rolls 25, 27. The fabric is then directed over idler roll 28, equipped with load cell blocks 27 mounted on each end of idler roll 28. The output from load cell blocks 27 (serving the same purpose as a dancer roll) is used to regulate the relative speed of drive rolls 24, 26 with the next pair of drive rolls 32, 32*a*, and thereby control the tension of the web 8.

The web is then directed into contact with treatment rolls or tubes 11, 11*a*, which are interspersed with idler rolls 29, 29*a*. In a most preferred embodiment, the treatment rolls or tubes 11, 11*a* are configured in pairs, with a first roll or tube rotating in an opposite but even direction from the second roll or tube 11, 11*a*. Such a configuration gives the most balanced and thorough treatment of the fabric web 8. The drawings show a particular orientation of the web 8 to the treatment rolls 11 wherein first one side and then the other side of the web is contacted by the treatment rolls 11. However, the idler rolls 29 and treatment rolls 11 are symmetrically oriented in a line, so that the web path may be altered by threading up the web to either side of the treatment rolls 11, so that either the face or back of the web is treated by a particular treatment roll 11, as desired for a particular fabric style.

After treatment in chamber 12, the web 8 passes into intermediate chamber 100, passing under scroll roll 30 to idler roll 31, which is mounted each end on load cell blocks 27*a*, whereby tension of the web 8 is measured and compared to the tension measured with load cells 27, as a quality check. The web is then directed to drive roll 32, to idler roll 31*a* and to drive roll 32*a*, geared in a one to one relationship with drive roll 32. Subsequently, the web 8 passes under idler roll 31*b*, equipped at each end with load cell blocks 27*b*, which serve to control to tension of the web 8 in treatment chamber 10. The output from load cell blocks 27*b* is used to regulate the relative speed of drive rolls 32, 32*a* with the next pair of drive rolls 34, 36, and thereby control the tension of the web 8 within the chamber 10.

The web passes under scroll roll 30*a*, which serves to further open the web before entering the treatment chamber 10. This opening is particularly desirable if the tension used in the treatment chamber 10 is less than that used in treatment chamber 12.

The fabric web 8 then enters treatment chamber 10, wherein spaced idler rolls 29*a* serve to contact the web against treatment rolls 11*a*. Again, the drawings show a particular orientation of the web to the treatment rolls 11 wherein first one side and then the other side of the web is contacted by the treatment rolls 11*a*. However, the idler rolls 29 and treatment rolls 11 are symmetrically oriented in a line, so that the web path may be altered so that either that the face or back of the web is treated by a particular treatment roll 11*a*, as desired for a particular fabric style.

After treatment in chamber 10, the fabric is directed around idler roll 30*b*, equipped at each end with load cell blocks 27*c*, whereby tension of the web 8 is measured and compared to the tension measured with load cells 27*b*, as a quality check. Subsequently, the web 8 is directed over idler roll 33 to drive rolls 34, 36, which are geared together in a one-to-one relationship by means of a synchronous belt (not shown). Sufficient wrap on the drive rolls to achieve traction on the web is accomplished by directing the web over idler rolls 35, 38. The web is then directed away from the apparatus 9.

The entire apparatus 9 is sealed to prevent leakage of lint into the environment. Slideable windows 14, 16, 18, 20 allow the treatment areas to be accessed and viewed. Lint created by contact of the web 8 with the treatment rolls 11 falls into the intermediate chamber 100 and is removed by ductwork attached thereto (not shown).

Although the preferred apparatus comprises eight treatment rolls or tubes, it is to be understood and would be well appreciated by one of ordinary skill in the art that any number of rolls or tubes may be utilized. In fact, the same apparatus but with four treatment rolls, either in one chamber or separated into two mirror-image chambers are preferred as well. The examples listed below actually utilized a four-roll configuration in a single chamber.

DETAILED DESCRIPTION AND PREFERRED EMBODIMENTS OF THE INVENTION

The above as well as other objects of the invention will become more apparent from the following detailed examples representing the preferred embodiments of the invention.

A of 7.5 ounce per linear yard (63 inches wide) warp-faced twill fabric comprised of 100% cotton and completely constructed of size-coated open-end spun yarns was treated with the four-roll apparatus described in relation to FIG. 1, above, where the treatment rolls (or tubes) were three inches in diameter and coated with 400 U.S. grit diamonds in an electroplated nickel matrix. The measured fabric tension was equal to about 2 pounds per linear inch of fabric width. These rolls (or tubes) were paired wherein a first one rotated against the direction of fabric travel and a second rotated with the fabric travel direction, to provide a balanced and thorough abrasive treatment of the target fabric. After this initial treatment, the fabric was then scoured to remove substantially all of the size on the constituent yarns, bleached, and then immersed within a caustic solution (such as caustic soda, aqueous NaOH, and the like) for about 2 hours time elapsed, etc.) to effectuate mercerization. The mercerized fabric was then subjected to a subsequent sueding treatment through the same apparatus as utilized in the initial immobilized treatment, above. The resultant fabric exhibited an unexpectedly soft hand and a short pile. The same type of fabric was also only initially treated by the apparatus described above (and with immobilized fibers which retained size) and subsequently mercerized (as above). The resultant fabric exhibited a relatively soft hand, albeit not as soft as the fabric subsequently treated with a second finishing step.

In comparison, the same type of fabric was first mercerized (as above), and then treated with the same apparatus. The resultant hand was far more harsh and scratchy than the inventive fabrics above.

It is not intended that the scope of the invention be limited to the specific embodiments described herein, rather, it is intended that the scope of the invention be defined by the appended claims and their equivalents.

What is claimed is:

1. A process for finishing fabrics comprising:

(a) providing a textile fabric web containing at least 25% by weight of cotton fibers;

(b) subjecting at least a portion of said textile web from step "a" to a treatment selected from the group consisting of sanding, abrading, and napping.

(c) mercerizing said textile fabric web; and (d) subjecting at least a portion of said textile web from step "c" to a treatment selected from the group consisting of sanding, abrading, and napping.

2. A fabric treated in accordance with the process of claim 1.

3. The process of claim 1 wherein the fabric contains at least 40% of cotton fibers.

4. The process of claim 1 wherein the fabric contains at least 50% of cotton fibers.

5. The process of claim 1 wherein the fabric contains substantially all cotton fibers.

6. The process of claim 1 wherein said fabric from step "a" is in its greige state.

7. The process of claim 1 wherein said fabric comprises fabrics selected from the group consisting of woven, knit, non-woven, and any combinations thereof.

8. The process of claim 1 wherein said fabric is a warp-faced twill fabric.

9. A process for finishing fabrics comprising:

(a) providing a textile fabric web containing at least 25% by weight of cotton fibers;

(b) immobilizing at least a portion of the fibers of said textile fabric web;

(c) subjecting at least a portion of said textile web from step "b" to a treatment selected from the group consisting of sanding, abrading, and napping.

(d) mercerizing said textile fabric web; and (e) subjecting at least a portion of said textile web from step "d" to a treatment selected from the group consisting of sanding, abrading, and napping.

10. A fabric treated in accordance with the process of claim 9.

11. The process of claim 9 wherein the fabric contains at least 40% of cotton fibers.

12. The process of claim 9 wherein the fabric contains at least 50% of cotton fibers.

13. The process of claim 9 wherein the fabric contains substantially all cotton fibers.

14. The process of claim 9 wherein said fabric of step "a" is in its greige state.

15. The process of claim 10 wherein said fabric comprises fabrics selected from the group consisting of woven, knit, non-woven, and any combinations thereof.

16. The process of claim 10 wherein said fabric is a warp-faced twill fabric.

17. The process of claim 9 wherein step "b" is performed by coating said fabric to immobilize the fibers within said fabric within a coating matrix.

18. The process of claim 17 wherein said coating matrix is size.

19. A process for finishing a cotton-containing fabric, wherein said fabric contains at least 25% by weight of cotton fibers, said process comprising the sequential steps of (a) applying size to a plurality of yarns;

(b) weaving said plurality of yarns together to form said cotton-containing fabric comprising at least some fibers immobilized by said applied size; and (c) treating said fabric comprising said immobilized fibers through a finishing step selected from the group consisting of sanding, sueding, and napping.

20. A process for finishing a cotton-containing fabric, wherein said fabric contains at least 25% by weight of cotton fibers, said process comprising the sequential steps of (a) applying size to a plurality of yarns;

(b) weaving said plurality of yarns together to form said cotton-containing fabric comprising at least some fibers immobilized by said applied size;

(c) treating said fabric comprising said immobilized fibers through a finishing step selected from the group consisting of sanding, sueding, and napping;

(d) removing said size from said finished fabric of step "c";

(e) mercerizing at least a portion of the finished fabric of step "d"; and (f) treating said mercerized fabric from step "e" through a finishing step selected from the group consisting of sanding, sueding, and napping.

* * * * *